US011801611B2

(12) United States Patent
Sumi et al.

(10) Patent No.: US 11,801,611 B2
(45) Date of Patent: Oct. 31, 2023

(54) PACKAGE OPEN KNIFE AND A PACKAGE OPEN KNIVES PACK

(71) Applicant: KAI R&D CENTER CO., LTD., Gifu (JP)

(72) Inventors: Kazuomi Sumi, Gifu (JP); Shogo Ochiai, Gifu (JP); Kazunobu Hara, Gifu (JP)

(73) Assignee: KAI R&D CENTER CO., LTD., Gifu (JP)

( * ) Notice: Subject to any disclaimer, the term of this patent is extended or adjusted under 35 U.S.C. 154(b) by 15 days.

(21) Appl. No.: 17/612,722

(22) PCT Filed: Aug. 22, 2019

(86) PCT No.: PCT/JP2019/032919
§ 371 (c)(1),
(2) Date: Nov. 19, 2021

(87) PCT Pub. No.: WO2020/261587
PCT Pub. Date: Dec. 30, 2020

(65) Prior Publication Data

US 2022/0234230 A1 Jul. 28, 2022

(30) Foreign Application Priority Data

Jun. 28, 2019 (JP) ..... 2019-121714
Aug. 20, 2019 (JP) ..... 2019-150771

(51) Int. Cl.
*B26B 27/00* (2006.01)
*B25G 1/10* (2006.01)
*B65B 69/00* (2006.01)

(52) U.S. Cl.
CPC ..... *B26B 27/005* (2013.01); *B25G 1/102* (2013.01); *B65B 69/0033* (2013.01)

(58) Field of Classification Search
CPC ..... B25G 1/102; B26B 27/005; B26B 27/007
(Continued)

(56) References Cited

U.S. PATENT DOCUMENTS 2,376,887 A * 5/1945 Waltern ..... B26B 27/005 30/2
2,853,778 A 9/1958 Pratt et al.
(Continued)

FOREIGN PATENT DOCUMENTS

CN 105501581 A 4/2016
DE 1553738 A1 9/1971
(Continued)

OTHER PUBLICATIONS

International Search Report corresponding to International Application No. PCT/JP2019/032919 dated Sep. 17, 2019 with English translation.

(Continued)

*Primary Examiner* — Omar Flores Sanchez
(74) *Attorney, Agent, or Firm* — Renner, Otto, Boisselle & Sklar, LLP

(57) ABSTRACT

A package opening knife has a body part, a blade part, a gripping part that extends in an elongated shape in a prescribed first direction, and a guide part provided with a guide surface that slides in a surface direction of the package in a state of contacting the package to guide movement of the blade part. When a surface direction of the guide is defined as a second direction, the first direction and the second direction become substantially parallel to each other.

2 Claims, 15 Drawing Sheets

(58) Field of Classification Search
USPC ..... 30/2
See application file for complete search history.

(56) References Cited

U.S. PATENT DOCUMENTS

| | | | | |
|---|---|---|---|---|
| 3,230,620 | A * | 1/1966 | McKinley | B26B 27/005 30/294 |
| 4,012,836 | A * | 3/1977 | Baer | B26B 5/001 30/2 |
| 4,167,810 | A * | 9/1979 | Gilbert | B26B 5/002 30/294 |
| 4,295,273 | A | 10/1981 | Matthews | |
| 4,408,396 | A | 10/1983 | Scholl | |
| 5,697,157 | A | 12/1997 | Votolato | |
| 6,321,454 | B1 * | 11/2001 | Wass | B26B 29/06 30/294 |
| 7,228,631 | B2 * | 6/2007 | Denker | B27G 17/025 15/236.1 |
| 8,695,221 | B2 * | 4/2014 | Hao | B26B 5/001 30/162 |
| 10,913,168 | B1 * | 2/2021 | Salvitti | B26B 1/04 |
| 2004/0154167 | A1 * | 8/2004 | Yu Chen | B65B 69/0033 30/2 |
| 2007/0204435 | A1 * | 9/2007 | Pangborn | B25G 1/102 16/430 |
| 2015/0040406 | A1 | 2/2015 | Votolato | |
| 2017/0057102 | A1 | 3/2017 | Watanabe et al. | |
| 2019/0314974 | A1 * | 10/2019 | Joseph | B25B 31/00 |
| 2021/0321796 | A1 * | 10/2021 | Fitzgerald | B25B 9/02 |
| 2022/0079219 | A1 * | 3/2022 | Kontura | A24F 23/04 |
| 2022/0297323 | A1 * | 9/2022 | Seferi | B26B 5/005 |
| 2022/0297325 | A1 * | 9/2022 | Rae | B25G 1/102 |
| 2022/0389724 | A1 * | 12/2022 | Cheng | E04F 21/1655 |

FOREIGN PATENT DOCUMENTS

| | | | |
|---|---|---|---|
| DE | 2625980 | A1 | 12/1977 |
| FR | 2366107 | A1 | 4/1978 |
| JP | H6-23799 | U | 3/1994 |
| JP | 3013110 | U | 4/1995 |
| JP | H07-289749 | A | 7/1995 |
| JP | H7-284574 | A | 10/1995 |
| JP | 2001-170372 | A | 6/2001 |
| JP | 2003-326002 | A | 11/2003 |
| JP | 2005-198833 | A | 7/2005 |
| JP | 3140584 | U | 3/2008 |
| JP | 2016-192948 | A | 11/2016 |
| JP | 2017-046962 | A | 3/2017 |
| TW | 200718531 | A | 5/2007 |

OTHER PUBLICATIONS

Written Opinion corresponding to International Application No. PCT/JP2019/032919 dated Sep. 17, 2019.
Supplementary European Search Report of corresponding European Application No. 19935593.4, dated May 25, 2022.
Chinese Office Action of corresponding Chinese Application No. 201980097848.1, dated Nov. 28, 2022 with English translation.
International Preliminary Report on Patentability corresponding to International Application No. PCT/JP2019/032919 dated Dec. 28, 2021 with English translation.
Chinese Office Action of corresponding Chinese Application No. 201980097848.1, dated May 9, 2023 with English translation.

* cited by examiner

PACKAGE OPEN KNIFE AND A PACKAGE OPEN KNIVES PACK

This application is a national phase of International Application No. PCT/JP2019/032919 filed Aug. 22, 2019, which claims the priority of Japanese Patent Application JP 2019-121714 filed Jun. 28, 2019 and Japanese Patent Application JP 2019-150771 filed Aug. 20, 2019, all of which are hereby incorporated herein by reference in their entireties.

TECHNICAL FIELD

The invention relates to a technique to improve the workability of the package open knife which is especially used to open the package.

BACKGROUND OF THE INVENTION

JP 2017-46962 A1 (herein after referred to as "patent reference") discloses a cutter knife as a cutting means, for example, in a food processing field. This known cutter knife is manufactured by using metal such that the cutter knife is detectable for avoiding the unintentional remaining in the processed products. This cutter knife is further provided such that lubricant is not disposed between the metal parts while maintaining smooth movability of the metal parts.

On the other hand, not only in a food processing field as describe above, but also in various fields, operations are often taken place to cut and open the package in which predetermined articles are housed. In such operation, it is necessary not to damage the housed articles during the cutting operation of the package. In this respect, the known cutter knife is well structured for avoiding the unintentional remaining in the processed products or for avoiding unintentional mixing of any foreign matters into the processed products. However, the known knife is not aiming at further improvement of the workability of the package cutting and opening operation.

In other words, according the known cutter knife, while lubricant is not disposed between the metal parts, smooth movability of the metal parts is kept. However, the workability of using the blade body is not well secured. For example, when conducting the cutting operation by putting the blade into the package, a shortage of cutting depth or damaging onto the housed articles may possibly occur depending on finger forces of the user. This means, the operability of the package opening depends on the skill of the user. On the other hand, with respect to the chronicle shortage of human resources in the working field, it is strongly required to provide secured technique to improve the workability of package cutting and opening operation not depending on the proficiency of the user.

PATENT REFERENCE

JP2017-46962 A

DISCLOSURE OF THE INVENTION

Object of the Invention

The invention is made in terms of these aspects and its object is to provide an useful technique to surely improve the workability of the package open operation without respect to the proficiency of the worker.

Means to Achieve the Object

The invention is provided to achieve the above-described object. The invention relates to a package open knife to cut and open a package that houses containment. The package open knife includes a main body, a blade portion attached to the main body, a grip portion provided with the main body to elongatedly extend in a predetermined first direction and a guide portion. The guide portion includes a guide face to guide the movement of the blade portion by sliding in a face extending direction of the package in a state to face-contact with the package during the cutting operation of the package by the user holding the grip portion, wherein both the predetermined cutting depth and the predetermined cutting angle of the blade portion to the package are maintained.

According to the invention, the "containment" is defined one of or any combination of solid, liquid, viscous fluid and gas. The "package" is defined by one or any of paper, cardboard, vinyl, resin, metal film and other film-shaped article. The "cut" is defined by one or any of perfectly cutting the package and partially cutting the package. The "open" is defined by having the containment exposed to the outside of the package with or without taking the containment entirely or partially out of the package.

The blade portion is embedded to the main body to project from the front side of the main body by the predetermined amount obliquely in the first direction. Further, the blade portion includes a blade edge to cut the package in the draw-cutting direction defined by a direction from the blade portion to the grip portion.

According to the invention, the embedment of the blade portion is defined by the state that no clearance is made between the blade portion and the main body and the blade portion is fixedly secured to the main body. In other words, the embedment of the blade portion can be construed as "non-attachable" such that the blade portion can not be removed from the main body without destroying the package open knife.

By fixedly securing the blade portion to the main body, it can be completely alleviated that the relative position between the main body and the blade portion may possibly be shifted and thus, the workability of the cutting operation may possibly be decreased for example due to too strong pushing of the package open knife to the package. Further, with this construction, because no clearance is taken place between the blade portion and the main body, for example in a food processing workplace, any possibility of food materials intruding and remaining inside the package opening knife. Therefore, workability at the workplace where sanitary environment is strongly required can be enhanced.

Especially, the above-described construction may preferably be applied for a disposal usage to sequentially change the package open knife time by time for example in a food processing workplace where the use of the single package open knife in a long time should be avoided due to the sanitary reason.

According to the invention, the guide face guides the movement of the blade portion by sliding in a face extending direction of the package in a state to face-contact with the package during the cutting operation of the package by the user holding the grip portion. Both the predetermined cutting depth and the predetermined cutting angle of the blade portion to the package are maintained By such construction, the guide face can slide in the face extending direction of the package in a state to contact with the package. Further, the package cutting operation by the blade portion can be made in a state that the predetermined cutting depth and the predetermined cutting angle of the blade portion to the package are maintained This means that, just operating the package open knife by face-contacting the guide face with the package, the guide face can slide in the face extending direction of the package in a state that the cutting depth and the cutting angle are automatically set. Therefore, complete cutting and opening operation can be achieved without depending on the proficiency and technique of the user.

While the grip portion of the invention is defined by a member longitudinally extending in a predetermined first direction, the grip portion is not necessarily required to extend totally and completely straightforward, but can extend a little bit with curving and/or with other direction component. Further, the face extending direction in which the guide face slides is typically defined by a direction that the outer surface of the package extends. The "face" of the package can include one or any combination of plane face, curved face, non-continuous composite faces.

According to the package open knife of the invention, when the face extending direction of the guide face is defined as a second direction, the second direction is provided to be parallel with the first direction. By such construction, when the user conducts the cutting and opening operation of the package by holding the grip portion, the first direction which represents the extending direction of the grip portion and the second direction which represents the face extending direction of the package are substantially in parallel and the holding force of the user applied to the grip portion can be efficiently used to the cutting operation along the face extending direction of the package.

Further, according to the invention, the grip portion is provided with a length in the first direction to correspond to the entire length of a palm of the user holding the grip portion. Further, the grip portion includes a rib portion at the outer edge of the grip portion and a plate-like concave portion provided at the inside of the rib portion. The length corresponding to the entire length of a palm is defined by a size wherein the user can hold the grip portion substantially entirely by his (her) palm (or hand) and in this sense, the length can preferably be defined by a length approximately the same with the entire length of the palm, or a length longer or a little bit shorter than the length of the palm.

Further, according to the invention, the rib portion can secure the rigidity of the grip portion and the plate-like concave portion can decrease the weight by relative thinner dimension and thus, rational structure can be realized. The plate-like concave portion is defined by a plate-shaped region thinner than the rib portion with respect to the width of the grip portion. The concave portion preferably be defined by a recess or other thickness reduction.

Further, according to the invention, the concave portion includes a finger placing face for at least the thumb and the index finger of the user holding the grip portion. Because the thumb or the index finger can be placed on the plate-like concave portion, stable hooding of the grip portion by the user is secured. Typically, the ball of the thumb or the index finger can be placed. On the other hand, the invention does not always require the thumb or the index finger to be placed on the plate-like concave portion for holding the grip portion. Rather, in accordance with the operating circumstance and/or physical characteristics of the user, the status in which none of thumb and index finger is placed on the concave portion is not excluded.

Further, according to the invention, while the direction from the blade portion to the grip portion is defined as draw-cutting direction, the grip portion includes a finger engaging portion in a direction to cross the draw-cutting direction to apply the finger force of the user holding the grip portion during the cutting operation in the draw-cutting direction.

By such construction, workability of the draw-cutting operation can be enhanced. Note that the structure of the finger engaging portion in a direction to cross the draw-cutting direction is corresponding to the aspect that the finger engaging portion prohibit the finger of the user from moving in a draw-cutting direction during the draw cutting operation.

As a specific structure, the finger engaging portion includes an inclined engaging portion obliquely inclined to the first direction to engage with the thumb or index finger of the user, a concave engaging portion to dent in a direction to cross the longitudinal direction to engage with the index finger or the middle finger of the user, a projected engaging portion projecting in a direction to cross the longitudinal direction at a rear side of the grip portion to engage with the ring finger or the little finger. The inclined engaging portion, concave engaging portion and the projected engaging portion are preferably be integrally formed for example at the time of manufacturing the main body.

As to the inclined engaging portion, it engages the finger during the draw-cutting operation by engaging fingers of the user, especially the thumb or index finger with the inclined (crossing) region to the first direction.

As to the concave engaging portion, the finger of the user, especially index finger or middle finger can be put onto the concave engaging portion and thus, the finger engagement is done during the draw-cutting operation. Specifically, the concave engaging portion may preferably be provided at the front side of the grip portion and the workability of the draw cutting operation can be enhanced by putting the index finger or middle finger of the user onto the concave engaging portion. This is because the index finger and the middle finger are fingers which can apply relatively stronger force than other fingers.

As to the projecting engaging portion, it receives the finger of the user, especially the little finger or the ring finger for an engagement during the draw cutting operation. Specifically, the projecting engaging portion may preferably be provided at the rea side of the grip portion and the workability of the draw cutting operation can be enhanced by receiving the little finger or the ring finger of the user by the projecting engaging portion. This is because the little finger and the ring finger are fingers which can be easily gripped during the draw cutting operation.

Note that it is not necessarily required that all corresponding fingers should be engaged by the respective engaging portions during the operation. Rather, one or any of fingers can be free from the engagement of the corresponding engaging portion in accordance with the working environment and physical characteristic of the user.

Further, in order to secure the finger engagement, each of the engaging portion may preferably be provided with anti-slip such like a convex-concave structure and/or rubber.

As a further preferable aspect of the invention, the obtuse angle may be provided between the blade portion extending direction and the grip portion extending direction. The package open knife may preferably include a connecting region at the main body between the blade portion and the grip portion to connect the blade portion and the grip portion by extending in a direction to cross with the first direction. Further, the contact avoiding region may preferably be provided by the grip portion, connection region and the guide portion to avoid the contact of the finger of the user holding the grip portion with the package during the cutting operation of the package by the blade portion.

By such construction the finger of the user can be avoided from contacting the package and the workability can be enhanced especially in a food processing field in which the sanitary management is strictly required.

Note that the connecting region is required to extend in a direction to cross with the first direction (namely in an extending direction of the grip portion). However, it may extend for example in a extending direction of the blade portion.

As a further preferable aspect of the invention, a package open knives pack in which a plurality of the package open knives as defined above are accommodated may be provided. Preferably, each of the accommodated package open knife may be provided with an identifier to identify to each other. The identifier may preferably be defined by the coloring portion provided at the main body each package open knife.

By such construction, in a working environment in which a plurality of workers may use the package open knives pack or in a disposal working environment in which the package open knife is changed time by time (or day by day) without reuse, the package open knife already used for the operation can be easily identified and the workability can be enhanced.

Note that the mutual identification can be made such that each package open knife accommodated in one package open knives pack are provided with various identifier different to each other, or such that one package open knives pack has identifier which is different from the identifier of the other package open knives pack and then, clarify each package open knife pertaining to which package open knives pack.

Further, the coloring portion as the identifier can be made for example by coloring the main boy by red, yellow, blue, green and so on. By such construction, each of the package open knife can be easily identified. Moreover, as to the coloring, different brightness of the same color, different pattern with the same or different color can be also used for the identifier, as well as the color variation.

According to the invention, effective technique to surely improve the workability of the package opening operation is provided without respect to the proficiency of the user.

Representative Embodiment of the Invention

A representative embodiment according to the invention is explained according to FIG. 1 to FIG. 7. FIG. 1 shows the entire structure of the package open knife 1 according to the embodiment as a front schematic view. FIG. 2 shows its plain schematic view. The package open knife 1 according to the embodiment is explained as an example of disposal type used in the food processing procedure in which the knife is discarded without changing the blade. The package open knife 1 is mainly provided with a main body 3 made of resin and a blade portion 5 made of metal.

(Structure of the Main Body 3 and the Guide Portion 9)

The main body 3 is formed by using resin. The material for the main body 3 is appropriately selected from, for example, PP (polypropylene), ABS, elastomer, polycarbonate and further, metal filler is mixed to be formed. The reason of mixing the metal filler is for securing the detectability by the metal detector in order to avoid unintentional remaining in the food processing procedure. The front tip end region 35 of the main body 3 is provided with a guide portion 9 and a blade portion embedded region 41, while the rear end region 37 is provided with a grip portion 7. The front tip end region 35 is connected with the grip portion 7 by a connecting region 47.

At the outer edge of the main body 3 including the grip portion 7 is provided with the thick rib portion 31 and the inside of the rib portion 31 is formed thin plate shaped as a concave portion 33 (see also FIG. 3). In this embodiment, the width of the rib portion 31 is provided as 6 mm (millimeter) and the width of the plate shaped concave portion 33 is provided as 2.5 mm (millimeter).

Further, the concave portion 33 is provided with a plurality of opening portions 32 and the opening portion 32 at the most rear end side defines the hook insertion hole 32 A that works for a hook for an engagement of the package open knife 1.

The guide portion 9 is provided with a guide face 10 having a face extending direction GD (referred to as "Second direction"). The guide portion 9 is disposed between the blade portion 5 and the grip portion 7 in the vicinity of the blade portion embedded region 41 at the tip end region 35 of the main body 3. (Structure of the blade portion 5 and the blade portion embedded region 41)

As shown in FIG. 3 as a cross section view at A-A line of FIG. 1 and in FIG. 4 as a cross section view at B-B line of FIG. 3, the blade portion embedded region 41 is provided at the tip end region 35 of the main body 3. A blade body 51 with a blade edge 52 for draw cutting operation is attached to the blade portion embedded region 41 in an embedded manner The blade body 51 is provided with textured blade style made by stainless steel. The blade body 51 is disposed in an extending manner in the blade body extending direction BD (also referred to as "Third Direction") crossing with the grip portion extending direction HD (First Direction, see FIG. 1). In the embodiment, the crossing angle of the grip portion extending direction HD and the blade body extending direction BD is provided to be 140 degrees at obtuse angle side (40 degrees at acute angle side).

Further, the blade body 51 is provided with a blade body fixing hole 53. The blade body fixing hole 53 is provided with resin material of the blade portion embedded region 41 and thus, a blade body fixing portion 45 is formed. As a result, the blade body 51 is fixedly and adhesively attached to the blade portion embedded region in a manner that the blade body 51 is unable to be changed.

Note that the blade body fixing hole 53 is provided at the forefront of the front tip end region 35 of the main body 3. Therefore, durability at the cutting and opening operation of the package can be enhanced in the event that strong force (high weight) is applied to the blade body 51.

(Manufacturing Steps by the Injection Molding)

When the main body 3 is manufactured by an injection mold, the blade body 51 is position-statedly set to the injection mold in a state that a jig is inserted into the blade body setting hole 43 as shown in FIG. 3, FIG. 4. And in that state, by injecting resin to the injection mold, the resin is filled into the blade body fixing hole 53 and the blade body fixing portion 45 is formed. Thus, the blade body 51 is integrally and adhesively provided with the blade portion embedded region 41 such that no space does exists around the blade body 51 (also called as "insert molding"). Note that the resin is not filled into the blade body setting hole 43 due to the fact that the jig is inserted into the blade body setting hole 43. Therefore, the blade body setting hole 43 remains open to the outside after the manufacturing. The blade body setting hole 43 is longitudinally formed to have a long hole in the blade body extending direction BD and thus, contributes to enhance the rigidity of the blade portion embedded region 41 of the main body 3.

During the injection molding, a guide portion 9 having a guide face 10 is formed at the same time in the vicinity of the blade portion embedded region 41 with which the blade body 51 is provided. The blade body 51 is fixedly adhesively and integrally attached to the blade portion embedded region 41 with no space (namely in the clearance non-forming state). Note that each of the inner edge region of the blade body fixing hole 53 and the blade body setting hole 43 are respectively rounded so as to prevent burr from generating during the manufacturing process.

(Structure of Grip Portion)

As shown in FIG. 1 and FIG. 2, the grip portion 7 is for the user to grip by his (her) fingers in order to conduct an operation (draw cutting) by means of the package open knife 1. The grip portion 7 is formed as an elongated body extending in a grip portion extending direction HD (also referred to as "First direction"). The grip portion 7 includes a first engaging portion 71, a second engaging portion 72 and a third engaging portion 73 crossing with the grip portion extending direction HD. The first engaging portion 71 correspond to the "inclined engaging portion" according to the invention, the second engaging portion 72 correspond to the "concave engaging portion" according to the invention, and the third engaging portion 7 correspond to the "projected engaging portion" according to the invention, respectively.

The first engaging portion 71 is formed at the upper side in the vicinity region from the grip portion 7 to the connecting region 47. The first engaging portion 71 is inclined to the grip portion extending direction HD and engageable with the thumb (first finger) or the index finger (second finger) of the user.

The second engaging portion 72 is formed at the lower side in the vicinity region from the grip portion 7 to the connecting region 47. The second engaging portion 72 is inclined to the grip portion extending direction HD and is concaved to the main body 3 and is engageable with the index finger (second finger) or the middle finger (third finger) of the user.

The third engaging portion 73 is formed in the vicinity of the rear side of the rear end region 37 of the main body 3. The third engaging portion 73 is formed as a projected engaging portion crossing the grip portion extending direction HD and is engageable with the little finger (fifth finger) or the ring finger (fourth finger) of the user.

The grip portion 7 according to the embodiment has length L1 corresponding to the entire length of the palm of the user in a state that the user holds the grip portion 7. The length L1 is provided approximately 70% of the entire length L2 of the package open knife 1. Specifically, L1 is 92 mm (millimeter) and L2 is 133 mm (millimeter). Accordingly, the user can use his (or her) entire palm to securely hold the grip portion 7.

Further, according to the embodiment, while the rib portion 31 enhances the rigidity of the grip portion 7, the plate-shaped concave portion 33 which is the region other than the rib portion 31 can be thinner to rationalize the construction. The plate-shaped concave portion 33 is a plate like region having a shorter length than the rib portion 31 in the width direction of the grip portion 7 and for example, a downgage can be applied to the concave portion 33.

Further, according to the embodiment, the plate-shaped concave portion 33 can be engageable at least with the thumb or the index finger of the user holding the grip portion 7 and thus, secured holding of the grip portion 7 by the user can be enhanced (see also FIG. 5).

(Structure of the Connecting Region 47)

The connecting region 47 extends in the grip portion extending direction HD, specifically in the blade body extending direction BD and connects the blade portion 5 with the grip portion 7 by means of the blade portion embedded region 41. The connection region 47 is provided with an anti-slip portion 74 having a convex-concave structure (groove shape) to enhance the secured holding by the fingers of the user during the cutting and opening operation of the package.

(Relationship between the Guide Portion and the Grip Portion)

According to the embodiment, the guide face extending direction GD of the guide portion 9 and the grip portion extending direction HD is arranged to be substantially parallel to each other. The effect of such parallel structure will be later explained.

(Protector Function)

The guide portion 9 is disposed between the blade portion 5 and the grip portion 7. The guide portion 9 separates fingers of the user holding the grip portion 7 from the blade portion 5 in order to prevent fingers from inadvertently approaching to the blade portion 9 and thus, functions as the finger protector.

(Usage and Operation of the Package open Knife)

Then, in reference to FIG. 5 and FIG. 6, the usage and operation of the package open knife 1 will be explained. As shown in FIG. 5, user holds the grip portion 7 of the package open knife 1 by the fingers F and then, draw-cut (tow-cut) in the draw-cut direction PD in a state that the guide face 10 of the guide portion 9 is in face contact with the outer face 101 of the package 100. The guide face 10 slides in the face extending direction FD of the package outer face 101 so as to guide the cutting operation of the package 100 by the blade body 51. At this state, the grip portion extending direction HD is provided to be substantially parallel to the face extending direction GD of the guide face 10 (see FIG. 1) and therefore, the draw-cut force of the user can be efficiently applied to the cutting operation without waist.

(Cutting Depth and Cutting Angle)

Further, the guide face 10 slides in the face extending direction of the package outer surface 101 and thus, as shown in FIG. 6, the cutting depth D to the package 100 by the blade body 51 is provided as constant. And further, the cutting angle θ between the blade body extending direction BD of the blade body 51 and the face extending direction FD of the package outer surface 101 is provided as constant.

(Easiness of Draw Cut)

Further, as explained above, the grip portion 7 is provided with the first engaging portion 71, the second engaging portion 72 and the third engaging portion 73. These portions make the draw-cutting operation easier. This is because in a state that the finger ball FH of the user is put on the upper surface of the grip portion 7, the grip portion 7 corresponds to the entire length of the palm of the user. And with respect to the crossing structure to the draw-cutting direction PD, the first engaging portion 71 engages with the thumb, the second engaging portion 72 engages with the index finger F2 or middle finger F3, the third finger 73 engages with the little finger F5 and further, the finger ball of the index finger F2 is put on the plate-shaped concave portion 33. As a result, the draw-cutting force of the user can effectively be transmitted to the blade portion 5. Note that, different from the state as shown in FIG. 5, it is also applicable such that, for example, the first engaging portion 71 engages with the index finger F2 and the thumb is put on the concave portion 33 or such that the first engaging portion engages with no finger and both finger balls of the thumb F1 and the index finger F2 are put on respective faces of the concave portion 33 opposing to each other.

(Contact Avoiding Region)

As shown in FIG. 1 and FIG. 5, the grip portion extending direction HD and the face extending direction GD of the guide face 10 are provided substantially to be parallel and the blade body extending direction BD and the grip portion extending direction HD are provided with predetermined obtuse angle (140 degrees in this embodiment). And the connecting region 47 extending in the blade body extending direction BD and crossing the grip portion extending direction HD is disposed. Thus, a space formed by the grip portion 7, connecting region 47 and the guide portion 9, namely a side from the grip portion 7 toward the package 100, is provided with a contact avoiding region. In other words, the length of the grip portion 7 in the grip portion extending direction HD and the length of the connecting region 47 in the grip portion extending direction HD defines the length of the contact avoiding region, while the length from the connecting region 47 to the guide face 10 in the direction perpendicular to the grip portion extending direction HD defines the height of the contact avoiding region. Accordingly, by means of the contact avoiding region, a space enough for the holding is formed between the grip portion 7 and the package outer surface 101 such that the fingers F of the user can be avoided from contacting with the package outer surface 101. Therefore, inadvertent contact of the fingers of the user with the package 100 can be avoided and operation can be optimized especially in a food processing field where sanitary control is strongly required.

(Package Open Knives Pack)

With respect to the package open knife 1, as shown in FIG. 7, a package open knives pack 90 can be provided in which a plurality of package open knife (Three in this embodiment) 1A, 1B, 1C are aligned and accommodated within the housing body 91 made by a transparent resin. By packaging the plurality of package open knife, a usage especially under the circumstances that huge numbers of package open knives with the same type are used (for example professional use) can be enhanced.

(Identifier)

In this case, the main body 3A, 3B, 3C of the package open knife 1A, 1B, 1C are respectively arranged with coloring portion 93A, 93B, 93C with different coloring to each other. Thus, each identification can be realized. In FIG. 7, the coloring difference is expressed by changing the hatching patter for the safe of convenience. Especially, in the food processing field where the package open knife 1 according to the embodiment is used, it should be avoided to use the same device in a long run. In this aspect, as a mutual identifier, each coloring of the package open knife 1A, 1B, 1C is different to each other and then, which package open knife is already used and which is non-use can clearly be identified and such problem can be effectively avoided.

Note that the embodiment adopted the aspect that package open knives accommodated in one package open knives pack 90 are having different coloring. However, another aspect can be adopted. For example, in a working circumstance where multiple package open knives packs are used, the first pack may have a predetermined coloring and all package open knife in the first pack are arranged to have the same coloring. On the other hand, the second pack may have another predetermined coloring and all package open knife in the second pack are arranged to have the same coloring different to the first pack. By such construction, package open knife in each pack can have different coloring and therefore, which package open knife is pertaining to which pack can be easily identified.

According to the embodiment, with respect to the package open knife, a technique to securely improve the workability without respect to the proficiency of the user can be provided.

(Indication of Entire Structure of the Package Open Knife Product According to the Embodiment)

Further, FIG. 8 shows entire structure of products (design) regarding the package open knife according to the embodiment as a front vie 101, right side view 102, left side view 103, plain view 104 and bottom view 105. Note that the rear view is the same appearance with the front view, its indication is abbreviated. projection view.

(Modification of the Embodiment)

Further, a modification of the above-described package open knives pack is explained based on FIG. 9 to FIG. 14. In this modification, as is shown in FIG. 9 and FIG. 10, a package open knives pack 900 which can accommodate 20 package open knives. Note that FIG. 9 shows the pack before the accommodation of the package open knife 1 and FIG. 10 shows the pack after the accommodation of the package open knife 1.

The package open knives pack 900 is mainly provided with a pack body 901 and a pack lid. At the outer edge of the pack body 901, a plurality of ribs 905 are intermittently formed and at the outer circumference of the pack lid 903, a plurality of rib connection portion 907 are formed. The rib 905 and the rib connection portion 907 contribute to the enhancement of the rigidity of the package open knives pack 900 and provide a taste tot the outer design.

Further, the pack body 901 is provided with a pack body side holding portion 911 respectively corresponding to the outer shape of the 20 package open knives 1 accommodated therein. On the other hand, the pack lid 903 is provided with a pack lid side holding portion 913 respectively corresponding to the outer shape of the 20 package open knives 1.

FIG. 12 is a A-A line cross section view of the pack body 901 in FIG. 9. FIG. 13 is a B-B line cross section view of the pack body 901 in FIG. 10. As shown in FIG. 12 and FIG. 13, a pack body side holding portion 911to hold the lower side of the package open knife 1 is sequentially formed corresponding to the numbers of package open knives 1 to be accommodated. Note hat the structure of the pack lid side holding portion 913 corresponding to the pack body side holding portion 911 is shown in FIG. 14 in greater detail.

The pack body side holding portion 911 and the pack lid side holding portion 913 are respectively able to connectingly hold the accommodated package open knife 1 at its outer shape. Therefore, inadvertent rattling during the transportation can be effectively prevented.

Further, FIG. 14 shows the entire structure of the package open knives pack 900 as a projection view. Namely, front view 921, right sided view 922, left side view 923, plain view 924, bottom view 925 are respectively shown. Note that the rear view is the same with the front view and therefore indication is abbreviated. Same, FIG. 15 shows the rear view 926.

FIG. 16 shows a entire structure of the pack lid 903 of the package open knives pack 900. Namely, front vie 931, right sided view 932, left side view 933, plain view 934, bottom view 935 are respectively shown. Note that the rear view is the same with the front view and therefore indication is abbreviated. Same, FIG. 17 shows the rear view 936.

EXPLANATION OF THE REFERENCES

Figure 1:
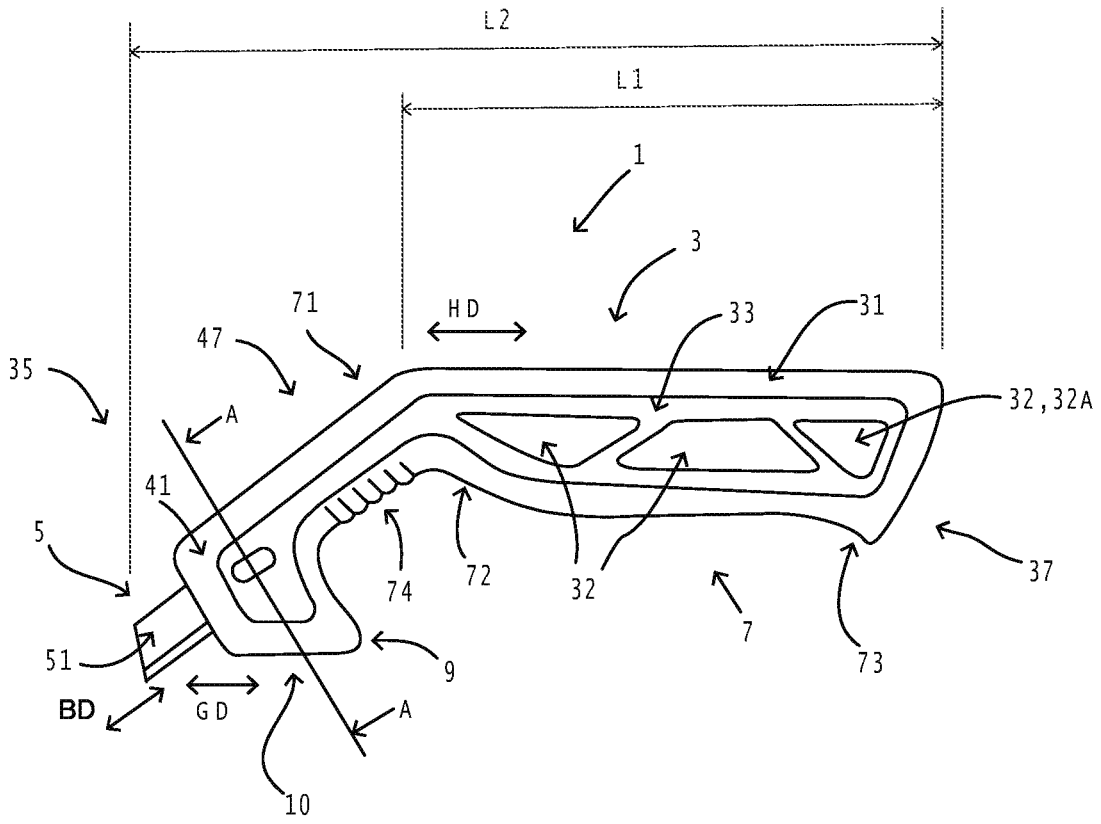
FIG. 1 shows the entire structure of the package open knife 1 according to the embodiment as a front schematic view
Figure 2:
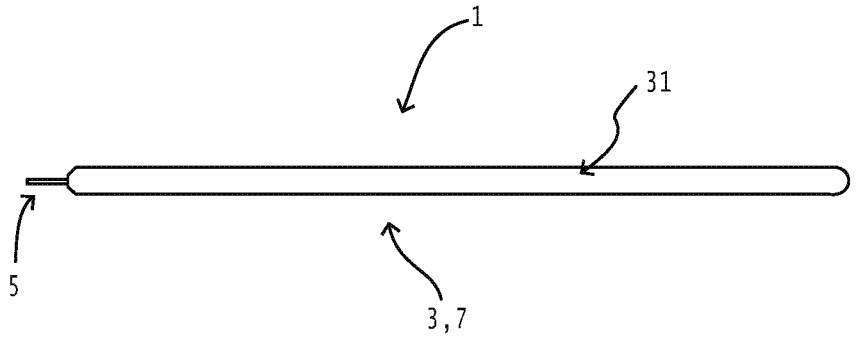
FIG. 2 shows the entire structure of package open knife 1 of FIG. 1 as a plain schematic view.
Figure 3:
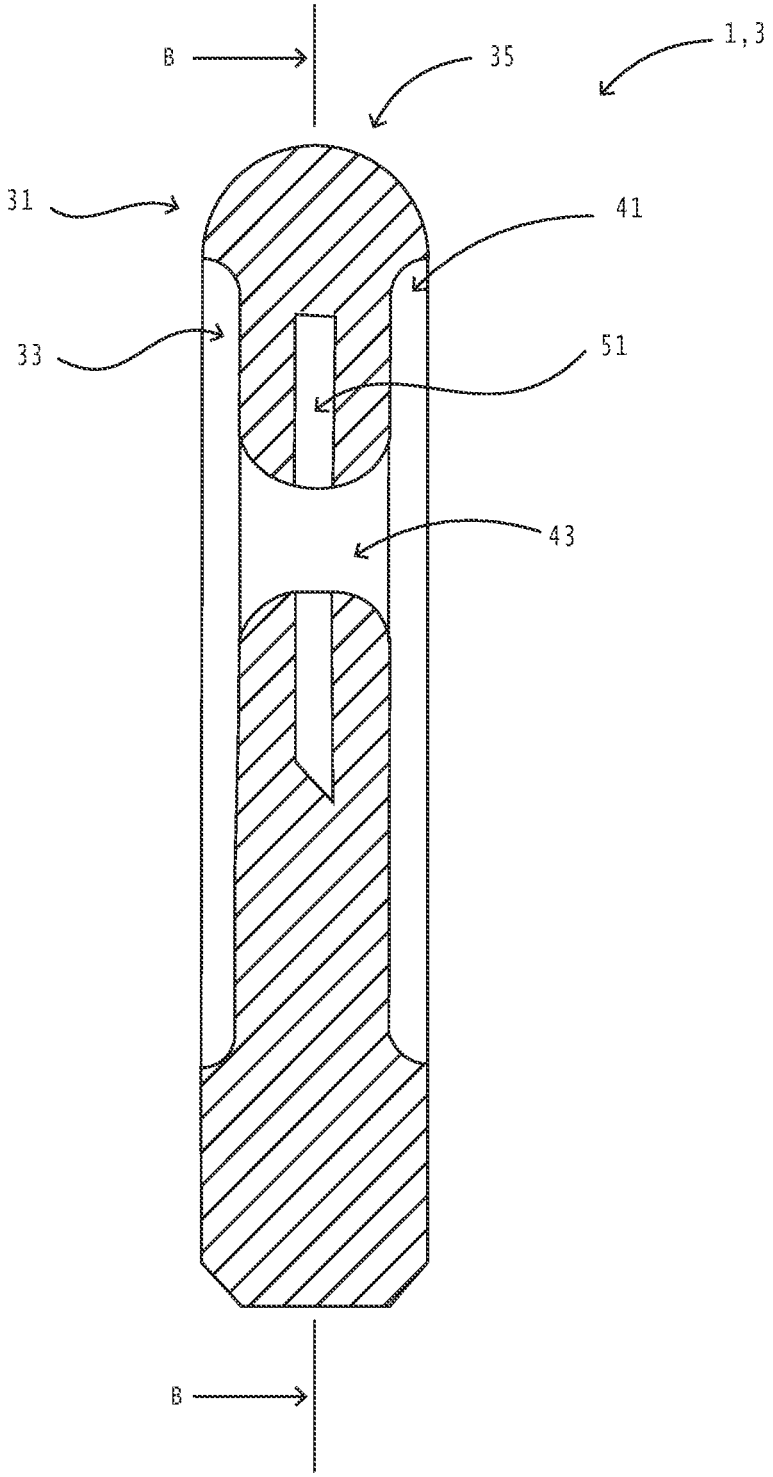
FIG. 3 shows cross section view at A-A line in FIG. 1.
Figure 4:
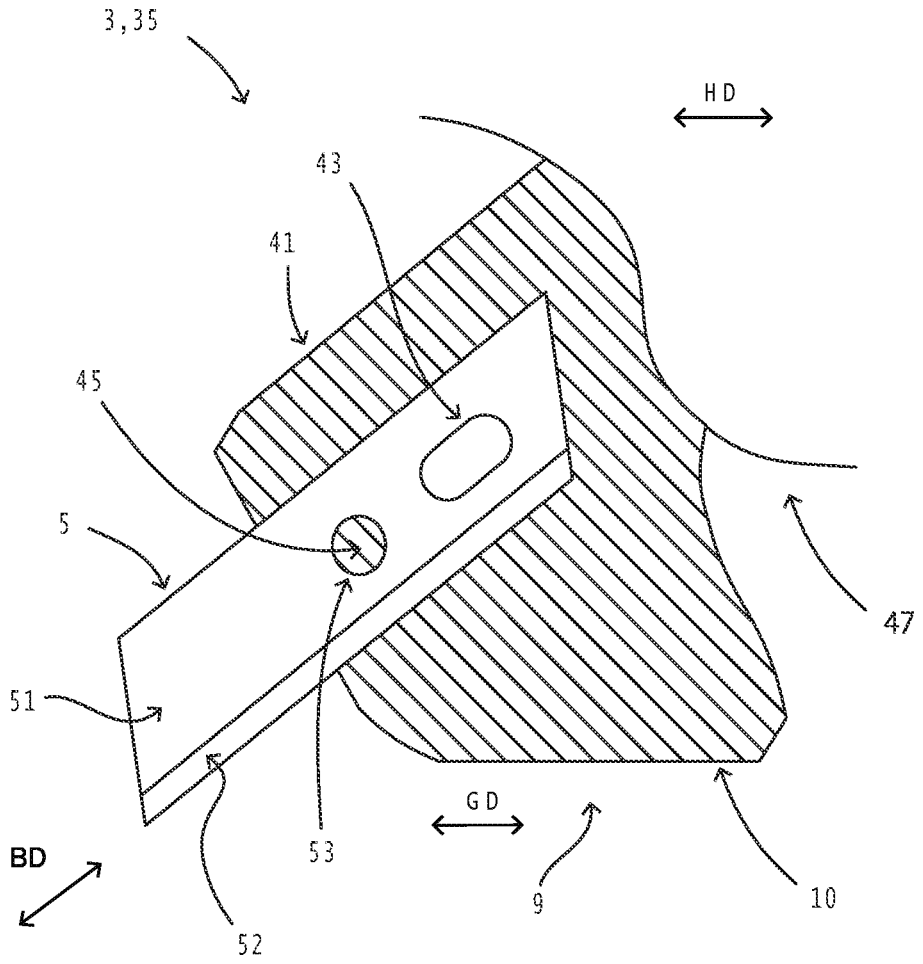
FIG. 4 shows cross section view at B-B line in FIG. 3
Figure 5:
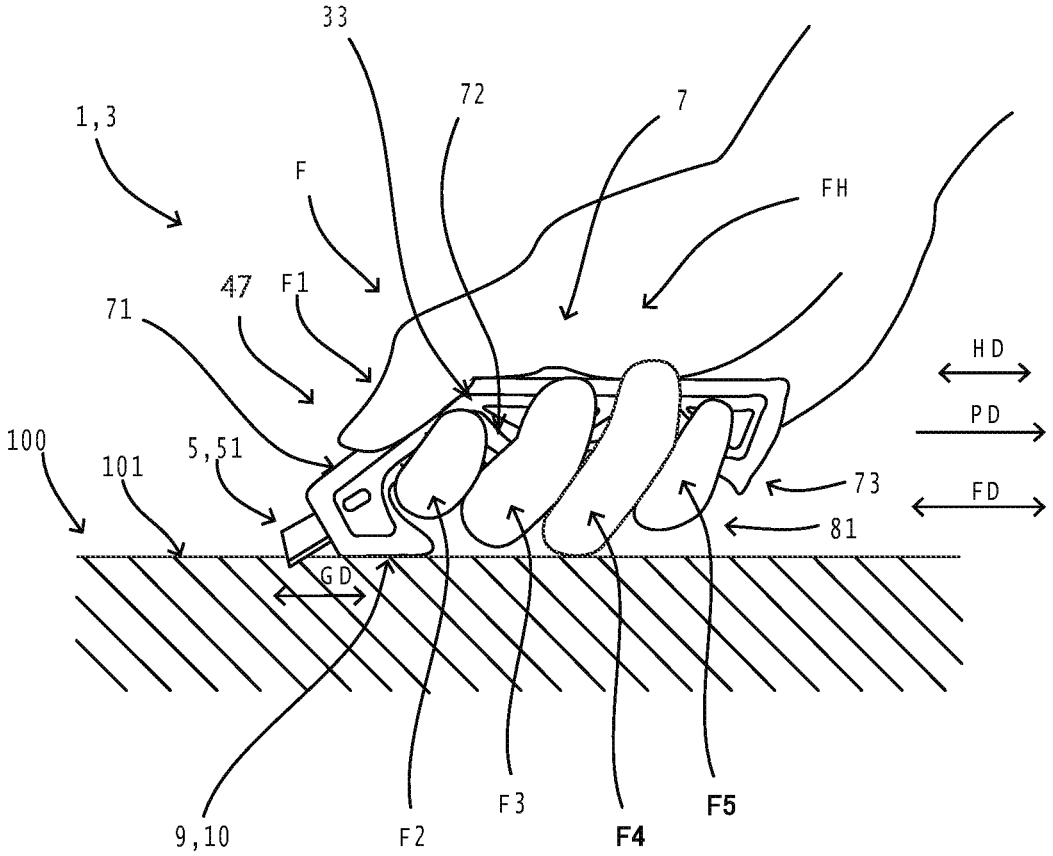
FIG. 5 shows the usage of the package open knife according to the embodiment as a schematic view.
Figure 6:
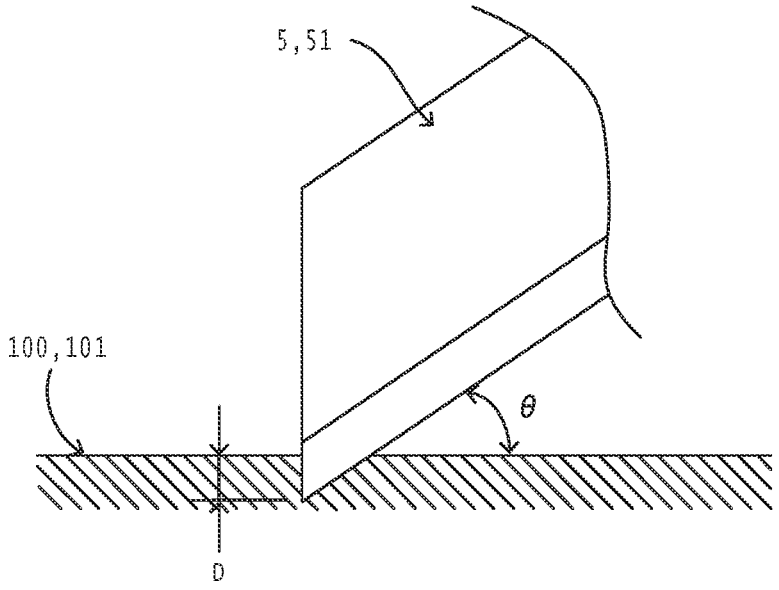
FIG. 6 shows the relationship between the cutting depth and the cutting angle as a schematic view in part.
Figure 7:
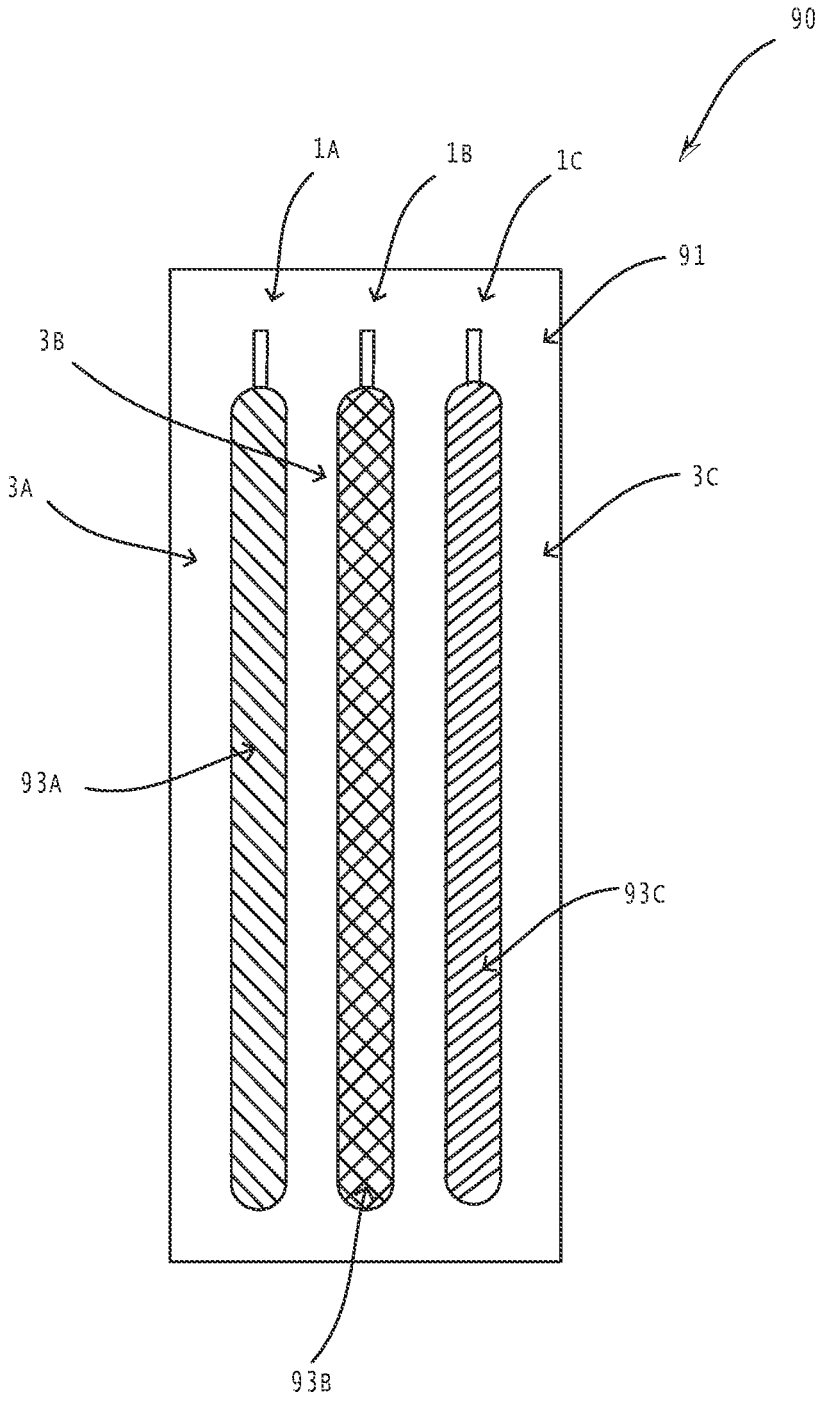
FIG. 7 shows the overview of the package open knife pack as a schematic view.
Figure 8:
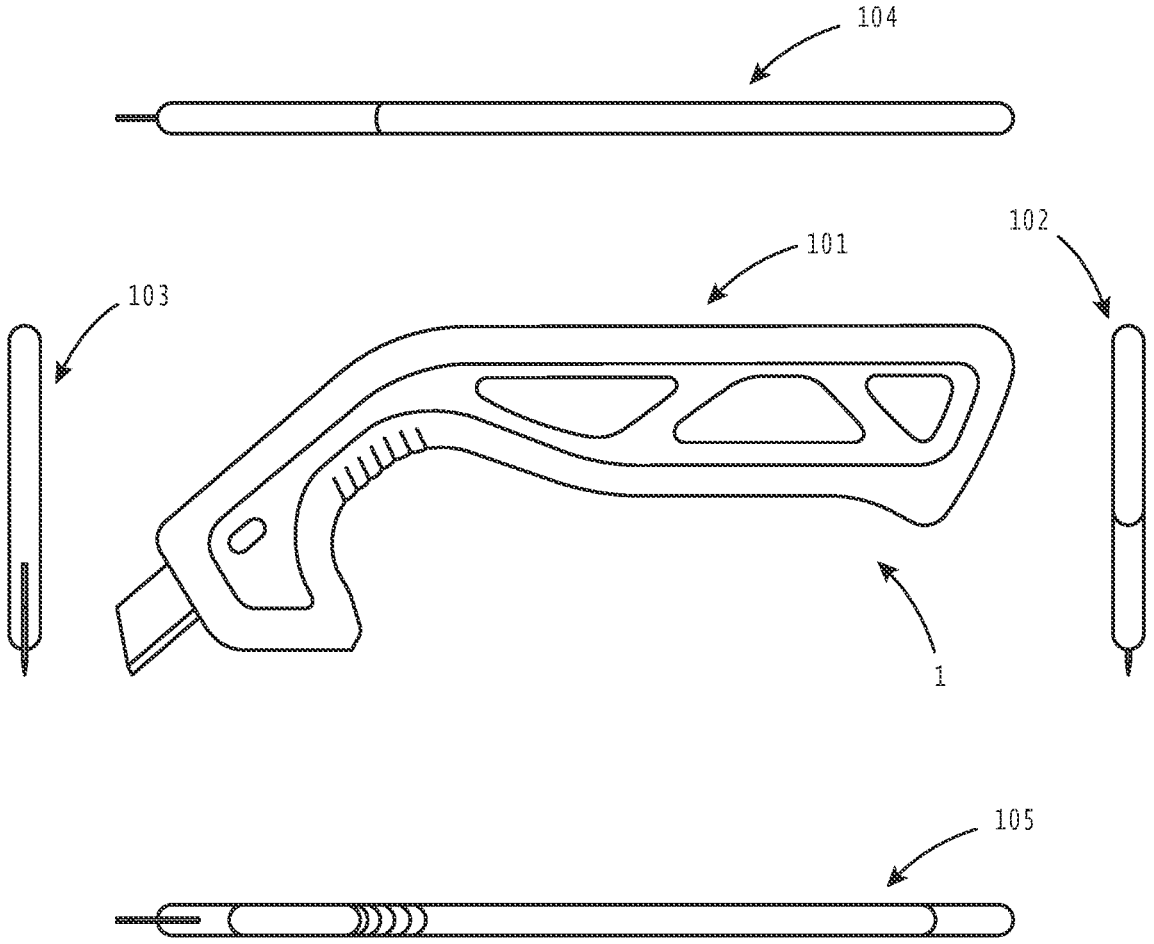
FIG. 8 shows entire structure of products regarding the package open knife according to the embodiment as a projection view.
Figure 9:
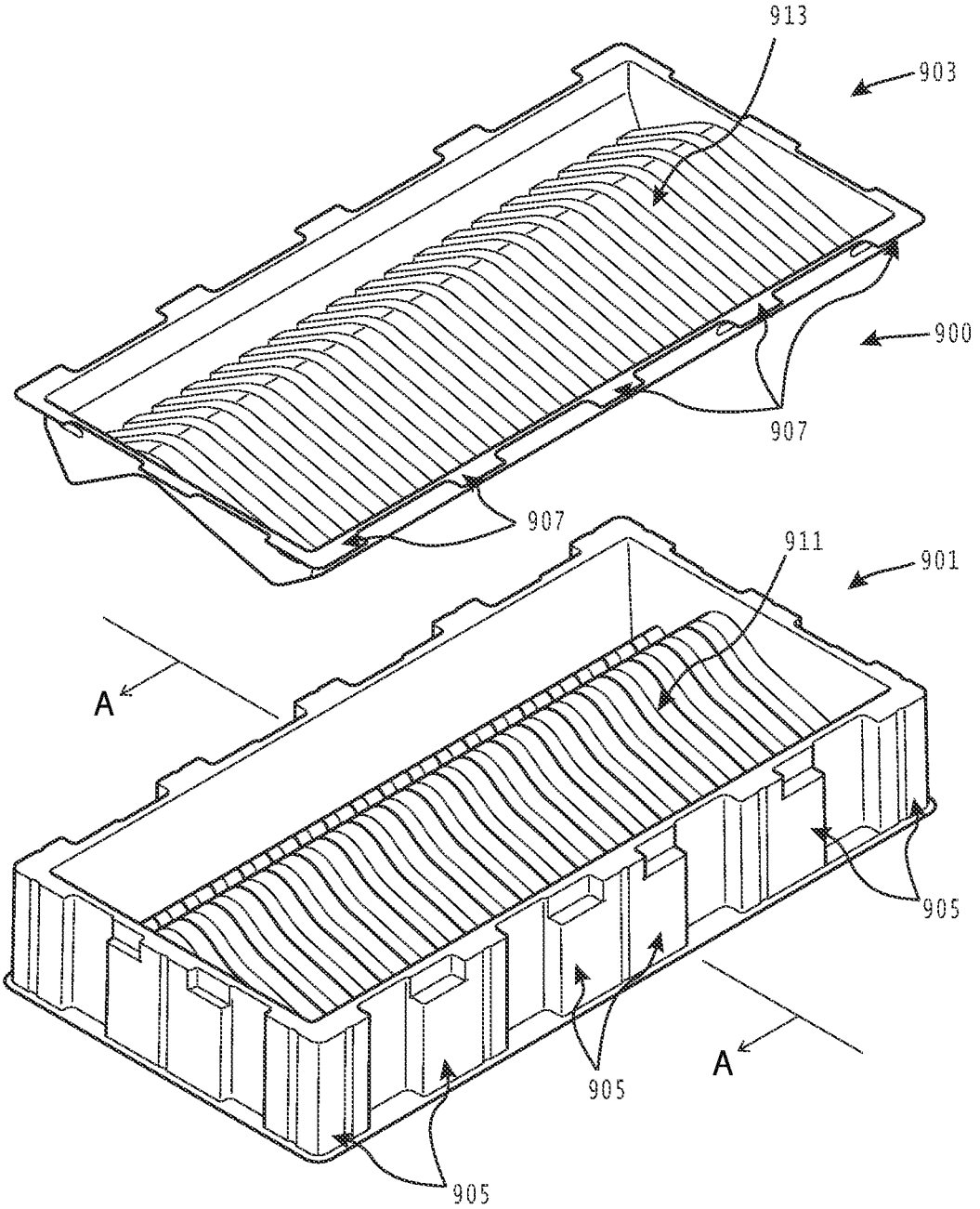
FIG. 9 shows entire structure of a modification of the package open knives pack according to the embodiment as a perspective view.
Figure 10:
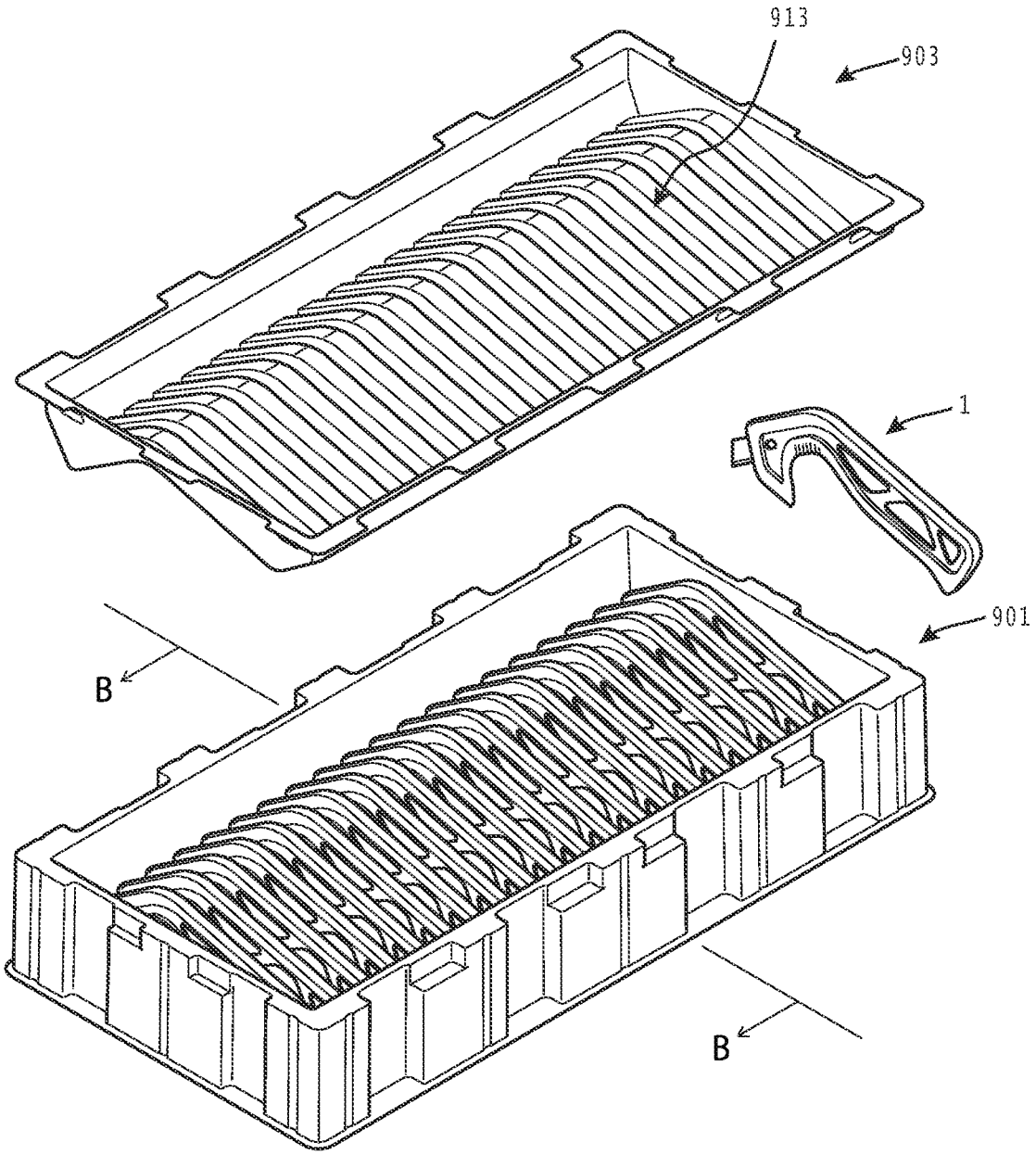
FIG. 10 shows entire structure of the modification of the package open knife in a state that the package open knifes are housed.
Figure 11:
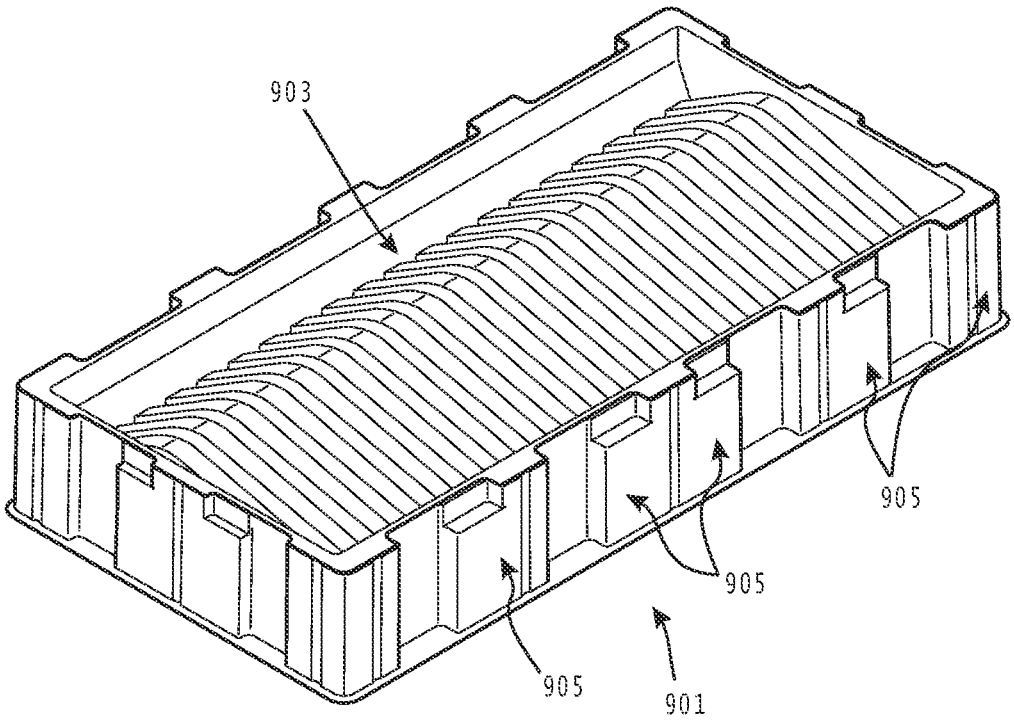
FIG. 11 shows entire structure of the modification of the package open knives pack in a state that the pack lid is connected with the pack body.
Figure 12:
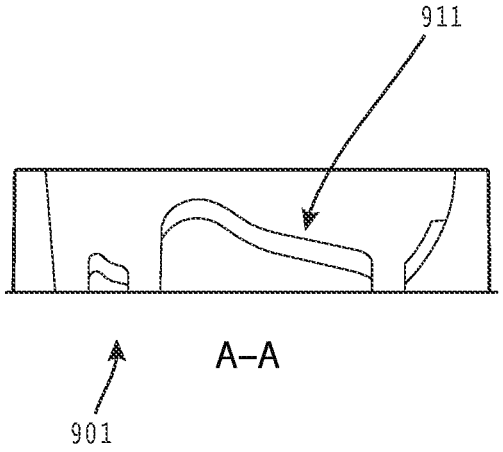
FIG. 12 shows the cross section view at A-A line in FIG. 9.
Figure 13:
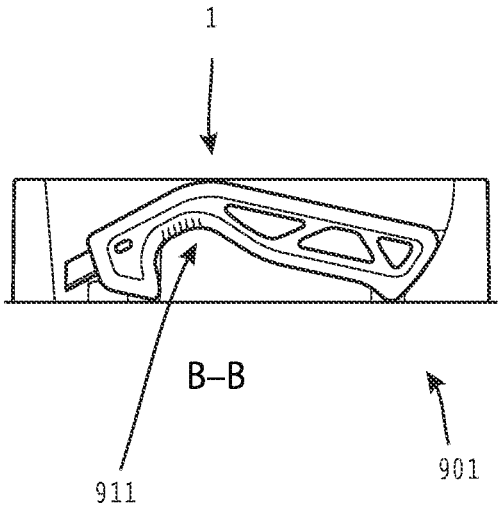
FIG. 13 shows the cross section view at B-B line in FIG. 9.
Figure 14:
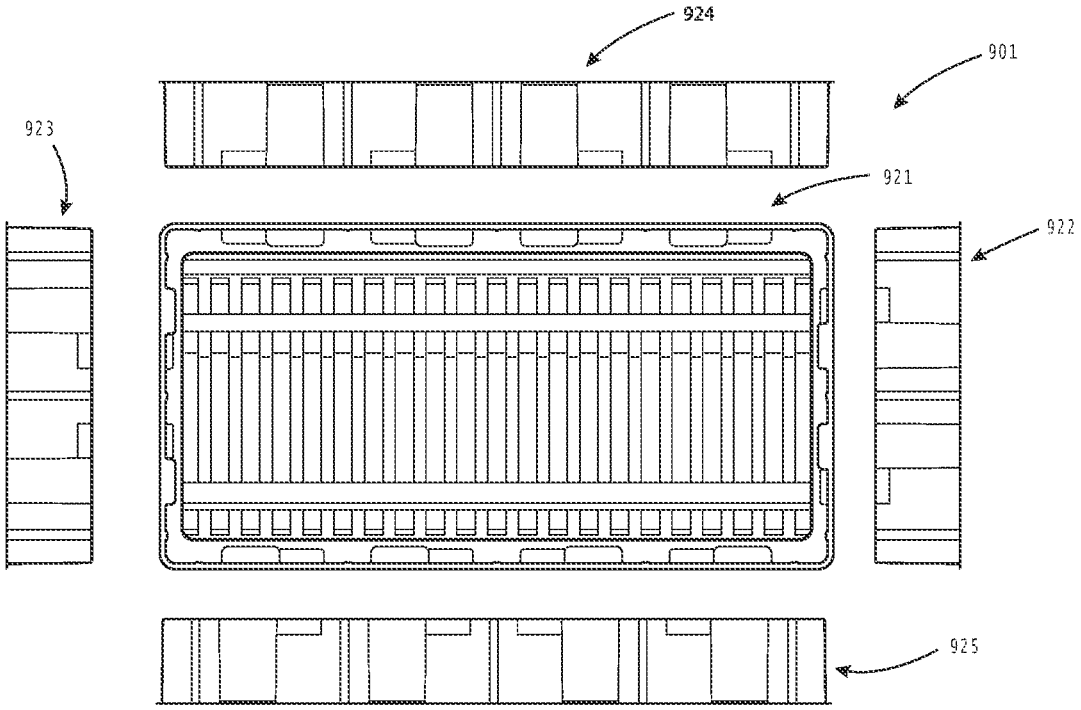
FIG. 14 shows entire structure of the modification of the package open knife as a projection view.
Figure 15:
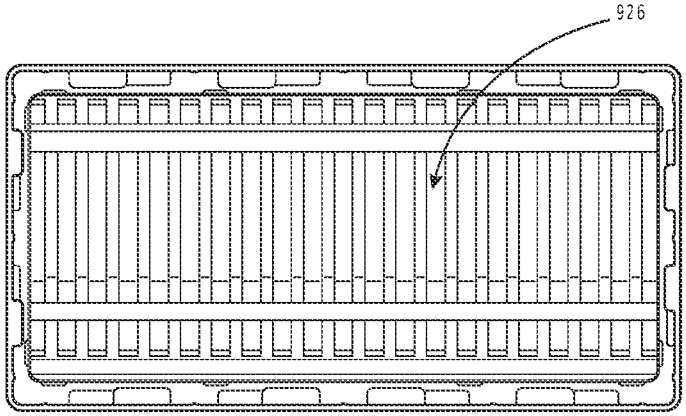
FIG. 15 shows rear view of the entire structure of the modification of the package open knife as a projection view.
Figure 16:
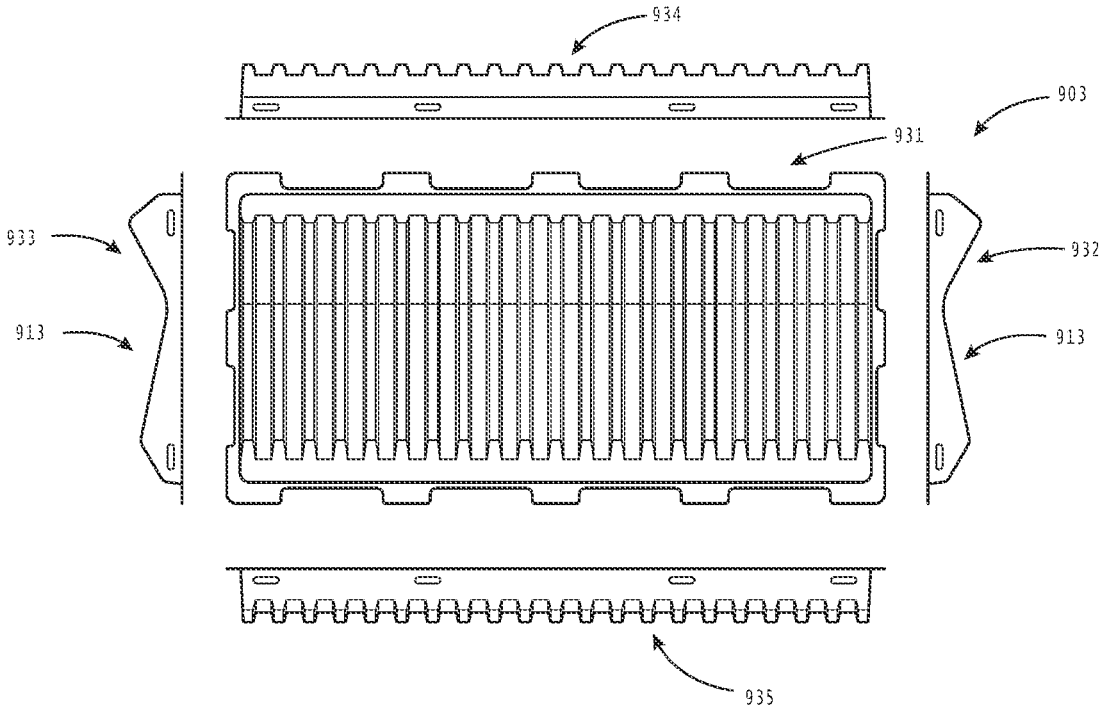
FIG. 16 shows entire structure of the pack lid of the modification of the package open knife as a projection view.
Figure 17:
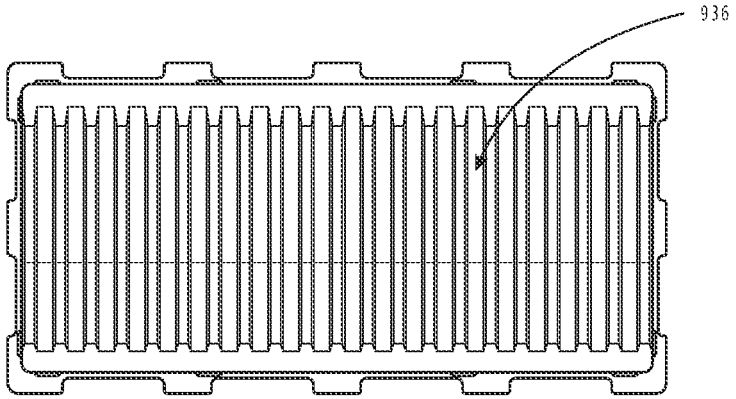
FIG. 17 shows rear view of the entire structure of the pack lid of the modification of the package open knife as a projection view.

1 Package open knife
3 Main body
5 Blade portion
7 Grip portion
9 Guide portion (Finger protector)
10 Guide face
31 Rib portion
32 Opening portion
32A Hook insertion hole
33 Concave portion
35 Main body tip end region
37 Main body rear end region
41 Blade portion embedded region
43 Blade body setting hole
45 Blade body fixing portion
47 Connecting region
51 Blade body
52 Blade
53 Blade body fixing hole
71 First engaging portion
72 Second engaging portion
73 Third engaging portion
74 Anti-slip portion
81 Contact avoiding region
90 Package open knives pack
91 Housing body
93 Coloring portion
100 Package
101 Package outer surface
HD: Grip portion extending direction (First direction)
GD: Guide face extending direction (Second direction)
BD: Blade body extending direction (Third direction)
PD: Package surface extending direction
PD: Draw-cutting direction
F: Fingers
FH: Finger ball
F1: Thumb (First finger)
F2: Index finger(Second finger)
F3: Middle finger (Third finger)
F4: Ring finger (Fourth finger)
F5: Little finger (Fifth finger)
D: Cutting depth
θ: Cutting angle
900 Package open knives pack
901 Pack body
903 Pack lid
905 Pack rib
907 Rib connecting portion
911 Pack body side holding portion
913 Pack lid side holding portion

The invention claimed is:

1. A package open knife to cut and open a package that houses containment, comprising:

a main body, a blade portion attached to the main body, a grip portion provided with the main body to elongatedly extend in a predetermined first direction and a guide portion, the guide portion having a guide face to guide the movement of the blade portion by sliding in a face extending direction of the package in a state to face-contact with the package during the cutting operation of the package by the user holding the grip portion, wherein both a predetermined cutting depth and a predetermined cutting angle of the blade portion to the package are maintained, wherein the blade portion is embedded to the main body to project from the front side of the main body by the predetermined amount obliquely in the first direction and the blade portion includes a blade edge to cut the package in the draw-cutting direction defined by a direction from the blade portion to the grip portion, wherein, when the face extending direction of the guide face is defined as a second direction, the second direction is provided to be parallel with the first direction, the grip portion is provided with a length in the first direction configured to be held substantially entirely by a palm of a user's hand, the grip portion having a rib portion at the outer edge of the grip portion and a concave portion provided at the inside of the rib portion, the concave portion includes a finger placing face on which at least the thumb and the index finger of the user holding the grip portion can be placed, the grip portion includes finger engaging portions in a direction to cross the draw-cutting direction to apply the finger force of the user holding the grip portion during the cutting operation in the draw-cutting direction, the finger engaging portions include, at the front side of the grip portion, an inclined engaging portion obliquely inclined to the first direction to engage with the thumb or index finger of the user and a concave engaging portion to dent in a direction to cross the longitudinal direction to engage with the index finger or the middle finger of the user, and at the rear side of the grip portion, a projected engaging portion projecting in a direction to cross the longitudinal direction to engage with the ring finger or the little finger of the user;

wherein the guide portion is disposed between the blade portion and the grip portion, wherein an obtuse angle is provided between the blade portion extending direction and the grip portion extending direction, the package open knife further comprising:

a connecting region at the main body between the blade portion and the grip portion to connect the blade portion and the grip portion by extending in a direction to cross with the first direction, and a contact avoiding region, provided in part by a space formed by the connecting region, to avoid the contact of the finger of the user holding the grip portion with the package during the cutting operation of the package by the blade portion.

2. A package open knives pack in which a plurality of package open knives are accommodated, wherein each package open knife includes a main body, a blade portion attached to the main body, a grip portion provided with the main body to elongatedly extend in a predetermined first direction and a guide portion, the guide portion having a guide face to guide the movement of the blade portion by sliding in a face extending direction of the package in a state to face-contact with the package during the cutting operation of the package by the user holding the grip portion, wherein both a predetermined cutting depth and a predetermined cutting angle of the blade portion to the package are maintained, wherein the blade portion is embedded to the main body to project from the front side of the main body by the predetermined amount obliquely in the first direction and the blade portion includes a blade edge to cut the package in the draw-cutting direction defined by a direction from the blade portion to the grip portion, wherein, when the face extending direction of the guide face is defined as a second direction, the second direction is provided to be parallel with the first direction, the grip portion is provided with a length in the first direction configured to be held substantially entirely by a palm of a user's hand, the grip portion having a rib portion at the outer edge of the grip portion and a concave portion provided at the inside of the rib portion, the concave portion includes a finger placing face on which at least the thumb and the index finger of the user holding the grip portion can be placed, the grip portion includes finger engaging portions in a direction to cross the draw-cutting direction to apply the finger force of the user holding the grip portion during the cutting operation in the draw-cutting direction, the finger engaging portions include, at the front side of the grip portion, an inclined engaging portion obliquely inclined to the first direction to engage with the thumb or index finger of the user and a concave engaging portion to dent in a direction to cross the longitudinal direction to engage with the index finger or the middle finger of the user, and at the rear side of the grip portion, a projected engaging portion projecting in a direction to cross the longitudinal direction to engage with the ring finger or the little finger of the user;

wherein the guide portion is disposed between the blade portion and the grip portion, and wherein each of the accommodated package open knives is provided with an identifier to identify to each other, the identifier is defined by the coloring portion provided at the main body of each package open knife.

* * * * *